United States Patent [19]

Ekbom

[11] Patent Number: 4,855,103

[45] Date of Patent: Aug. 8, 1989

[54] METHOD FOR MANUFACTURING METALLIC PRODUCTS FROM POWDER BY HOT ISOSTATIC PRESSING USING CERAMIC CORES

[75] Inventor: Ragnar Ekbom, Finspång, Sweden

[73] Assignee: Asea Stal AB, Finspang, Sweden

[21] Appl. No.: 124,102

[22] PCT Filed: Mar. 4, 1987

[86] PCT No.: PCT/SE87/00101

§ 371 Date: Dec. 21, 1987

§ 102(e) Date: Dec. 21, 1987

[87] PCT Pub. No.: WO87/05241

PCT Pub. Date: Sep. 11, 1987

[30] Foreign Application Priority Data

Mar. 4, 1987 [SE] Sweden ..... 8600965

[51] Int. Cl.[4] ..... B22F 7/04

[52] U.S. Cl. ..... 419/26; 419/8; 419/49

[58] Field of Search ..... 419/8, 26, 49

[56] References Cited

U.S. PATENT DOCUMENTS

| | | | |
|---|---|---|---|
| 4,063,939 | 12/1977 | Weaver et al. | 419/49 |
| 4,096,615 | 6/1978 | Cross | 419/49 |
| 4,097,276 | 6/1978 | Six . | |
| 4,323,394 | 5/1982 | Hoffmiiler et al. . | |
| 4,368,074 | 1/1983 | Otto, Jr. et al. . | |
| 4,383,809 | 5/1983 | Hoffmuller | 425/405.2 |
| 4,445,259 | 5/1984 | Ekbom | 419/49 |
| 4,526,747 | 7/1985 | Schimmel et al. | 419/8 |
| 4,575,327 | 3/1986 | Borchert et al. | 419/49 |
| 4,582,682 | 4/1986 | Betz | 419/49 |
| 4,680,160 | 7/1987 | Helmink | 419/49 |
| 4,729,789 | 3/1988 | Ide et al. | 419/8 |

FOREIGN PATENT DOCUMENTS

| | | |
|---|---|---|
| 0002918 | 7/1979 | . |
| 036202 | 9/1981 | . |
| 072424 | 2/1983 | . |
| 0073651 | 3/1983 | . |
| 2617336 | 11/1976 | Fed. Rep. of Germany . |
| 3005474 | 8/1981 | Fed. Rep. of Germany . |

OTHER PUBLICATIONS

ASEA Tidning, 1981.

*Primary Examiner*—Stephen J. Lechert, Jr.
*Assistant Examiner*—Eric Jorgensen
*Attorney, Agent, or Firm*—Merchant, Gould, Smith, Edell, Welter & Schmidt

[57] ABSTRACT

Method of manufacturing metal products from a powder (19) which is received in a mould cavity formed by a gas-tight casing (10, 11, 12, 13) and is isostatically hot pressed in the casing to form a monolithic body. A body (14) of graphite, hexagonal boron nitride, or another similar ceramic material is provided as a core in the mould cavity, and after the isostatic hot pressing this core is removed from the produced monolithic body by blasting.

1 Claim, 1 Drawing Sheet

Figure 1:
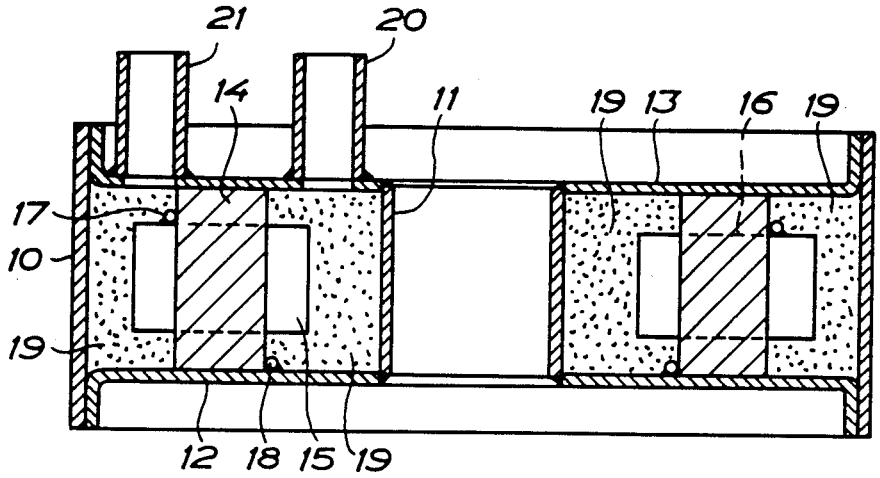

METHOD FOR MANUFACTURING METALLIC PRODUCTS FROM POWDER BY HOT ISOSTATIC PRESSING USING CERAMIC CORES

The invention relates to a method of manufacturing metal products from a powder which is received in a mould cavity formed by a gas-tight casing and is isostatically hot pressed in the casing to form a monolithic body.

In the manufacture of blade rings and hubs having blade rims for compressors or turbines by applying the isostatic hot pressing technique it has already been proposed to insert prefabricated blades through apertures which are matched to the cross section of the blades, in a wall of a casing wherein the ring or hub is to be produced by isostatic hot pressing of a metal powder. It is then necessary to make a gas-tight connection between the blades and the wall, which necessitates accurate welding at that side of the wall which faces the mould cavity. This working operation is expensive and time-consuming and cannot be repeated also at the other side of the wall, because there would then be produced at said side an irregularity in the flow passage, which generates turbulence which cannot be accepted. Accordingly, there will be a gap around the blade at said one side, and in some cases this gap cannot be accepted due to a marked fracture indication with associated reduction of the fatigue strength of the finished product.

The purpose of the invention is to overcome these drawbacks of the prior art method of manufacturing blade rings and hubs having blade rims, and at the same time facilitate adjustment of the detail design of the product while satisfying strict strength requirements. Thus, the invention has been developed primarily for the manufacture of monolithic bodies by isostatic hot pressing with prefabricated elements inserted therein, e.g. for the manufacture of blade rings and hubs having blade rims for compressors or turbines, said blades forming the prefabricated elements. However, the invention is not limited to the manufacture of these specific products; it is much broader than that.

The fact is that in isostatic hot pressing there is used at present occasionally cores of steel or other metal. As far as these cores cannot be withdrawn from the finished product, they are removed by etching. The drawback of such cores is that they are not shape-permanent at the high pressures and temperatures involved in isostatic hot pressing.

Cores of ceramic material are also used, however, and these cores contrary to the metal cores are shape-permanent but can be removed only by withdrawal, which restricts the use thereof.

In the specific case of attaching blades or other prefabricated elements the core also serves as a holder for maintaining these prefabricated elements in a fixed position by said elements being partly received by the core.

The material of the fixing body preferred at present, which is then blasted away, is hexagonal boron nitride, because the graphite tends to diffuse into the metal—at least so far no method or means has been invented in order to prevent this at the high temperatures involved—and consequently may cause a modification of the properties of the metal, which is not desired and cannot always be accepted. Although it has not been found by tests so far if there are other materials which are as good as hexagonal boron nitride for the related purpose or even better, it cannot be excluded that there is another similar ceramic material. In this connection a similar material means that the material can be easily machined, is shape-permanent at the high temperatures and pressures involved in isostatic hot pressing, and can be removed by blasting after the isostatic hot pressing.

Figure 2:
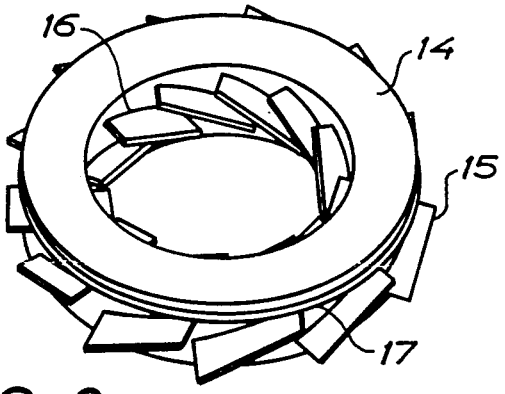
Figure 3:
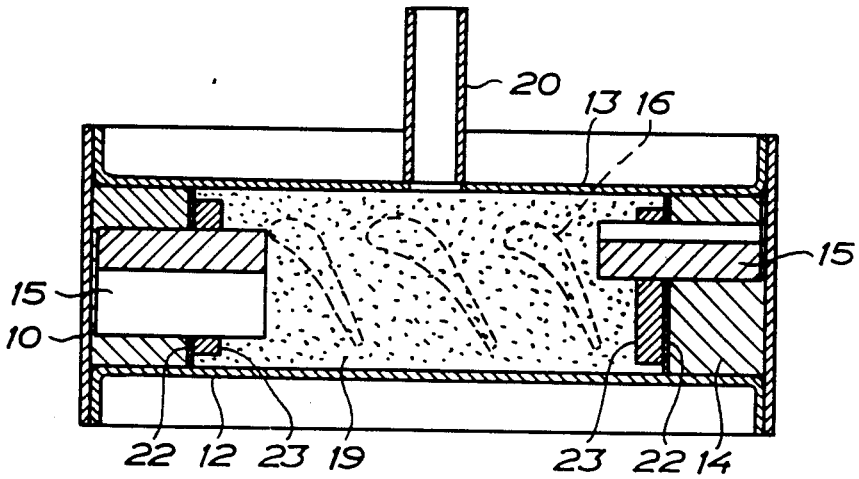

In order to explain the invention embodiments thereof will be described in more detail below applied to the manufacture of blade rings and hubs having blade rims, reference being made to the accompanying drawings in which FIG. 1 is an axial sectional view of a casing for isostatic hot pressing arranged for the manufacture of blade rings having a blade rim between the rings, FIG. 2 is a perspective view of the fixing body in the embodiment of FIG. 1 having the blades attached thereto, and FIG. 3 is an axial sectional view of a casing for isostatic hot pressing arranged for the manufacture of a hub having a blade rim.

Referring first to FIG. 1, a casing for isostatic hot pressing is shown therein which comprises an outer cylindric shell 10 of steel sheet, an inner cylindric shell 11 also of steel sheet, a circular annular bottom 12, and a circular annular cover 13, also these two being made of steel sheet, gas-tight connections being provided between said four elements by welding, because the casing must be gas-tight for isostatic hot pressing. Before the cover is mounted and attached to the two shells an annular body 14 supporting the blades 15 prefabricated e.g. by drawing and made of steel or a suitable alloy, is arranged in the mould cavity formed by the casing, said blades being finished to the final shape thereof.

The body which is shown also separately in FIG. 2 with the blades 15 inserted therein in the embodiment of the method of the invention preferred at present, consists of hexagonal boron nitride, a ceramic material which can easily be machined and can easily be removed by blasting and which combines these properties with shape permanency at the high temperatures and pressures involved in isostatic hot pressing. The bore nitride is available commercially as a powder, and the body 14 is made of such powder by initially isostatically hot pressing a solid cylindric body. The isostatic hot pressing is effected in a conventional manner, but since a ceramic material is involved, the temperature at the isostatic hot pressing must be higher than at conventional isostatic hot pressing of metal powder, viz. about 1700° C. At this high temperature the casing cannot be made of metal; it must be made of glass. From the cylindric solid body obtained the ring 14 is produced by machining. Apertures 16 for the blades are made in the ring also by machining, said openings being shaped as the blades and dimensioned so that the blades without any difficulty can be inserted therethrough. The ring has a radial thickness which is less than the length of the blades such that the blades can be disposed with the two end portions projecting at opposite sides of the ring as shown in FIGS. 1 and 2. The blades are fixed by means of a lock wire 17 which is spot welded to each blade. It is preferred that the apertures in the body 14 are curved at the opening edges at both sides of the body.

When the body with the blades attached thereto is then inserted into the mould cavity, it is located concentrically therein. It is fixed to the bottom 12 by means of spot welding at one side or the other of the ring as shown at 18. The remaining portion of the mould cavity in the casing is filled with the metal powder from which the isostatic hot pressed body is to be produced, as is shown at 19. Thus, there is powder at each side of the body 14, and the end portions of the blades projecting therefrom are embedded in the powder. Not until this has been done, the cover 13 is mounted tightly closing the casing with the body 14 spanning the distance between the bottom and the cover. In order to evacuate or degas the mould cavity the cover is provided with two connection sockets 20 and 21 one at each side of the body 14.

After this the isostatic hot pressing is performed in a completed conventional manner, powder and blades being interconnected to form a monolithic homogeneous body, the body 14 of boron nitride remaining on the blades between the two rings formed by the powder.

When the casing has been removed which can be done in a common manner by machining, and the body 14 thus has been uncovered, also this body is removed, which is made by blasting, so as to uncover the blades in the space between the rings. Then, the monolithic body is ready for the final finishing.

It is completely clear that the method of manufacture proposed by the invention is superior to the prior art method mentioned above, because the expensive and time-consuming welding around the blades is dispensed with. Since there is, moreover, the possibility of designing a transition between the rings and the blades, which is favourable as far as the strength is concerned, simply by curving the opening edges of the apertures for the blades in the body 14, the method of the invention is superior to the method previously applied in a further very important aspect.

The application of the method of the invention to a hub having a blade rim is illustrated in FIG. 3 where the same references have been used for elements shown already in FIGS. 1 and 2. In this case the blades project from the body 14 at one end portion thereof only, and only one socket 20 is necessary for the degassing, because there is powder in the mould cavity at the inner side of the ring only. The blades can be locked by means of a lock wire in the same manner as in FIGS. 1 and 2 although this has not been shown in FIG. 3. The manufacture of the monolithic body takes place in exactly the same way as in the embodiment of FIGS. 1 and 2 and therefore it would not be necessary to describe in detail the manufacture here. When the casing is peeled from the finished monolithic body it is possible in this case, because it is the question of a hub having a blade rim, to leave the outer shell 10 on the outer ends of the blades 15 as a band as can be desired in case of long blades. Moreover, there is disclosed in FIG. 3 a modification or refinement which deserves an explanation.

When blades are attached to rings or hubs in the well-known manner by using a fir-tree root connection or dovetail connection there is obtained at the attachment proper some attenuation of such vibrations to which the blade may be exposed during operation. Neither at the prior art manufacturing method mentioned above, nor at the manufacturing method described with reference to FIGS. 1 and 2 there is obtained such attenuation, but it can easily be achieved by applying the method of the invention. In FIG. 3 there is shown a cylindric metal sheet shell 22 disposed at the inner side of the body 14, and inwardly thereof a ring 23 is located which is passed onto the blades 15 at apertures matching therewith. This ring shall consist of an attenuating ceramic material e.g. boron nitride, which in this case can be cubic boron nitride, because the ring 23 shall not be removed; it will be embedded in the hub formed by the powder 19. It is thus possible to obtain in a simple manner the desired attenuation when applying the method of the invention.

Since it may be difficult to avoid that powder leaks into the apertures in the body 14 and then during the isostatic hub pressing combines with the blade material—as a consequence thereof the surface of the blades may be uneven and the blade profile may deviate from the intended profile—that portion of the blade surface which will be located inside the body 14 preferably is coated with a release agent such as alumina.

I claim:

1. Method of manufacturing metal products of a powder comprising the steps of disposing a core including a body of one of the materials in the group comprising graphite and hexagonal boron nitride, in a mold cavity formed by a gas-tight casing, filling the powder into said mold cavity, isostatically hot pressing the powder in the mold cavity to form a monolithic body thereof, and removing said core from the monolithic body by disintegrating the core by blasting.

* * * * *